US007396139B2

(12) United States Patent
Savage

(10) Patent No.: US 7,396,139 B2
(45) Date of Patent: Jul. 8, 2008

(54) UNDERWATER LIGHTING APPARATUS

(76) Inventor: Nigel C. Savage, 22 Kent Drive, Swallows Green, Hinckley, Leicestershire (GB) LE10 1UN ( * ) Notice: Subject to any disclaimer, the term of this patent is extended or adjusted under 35 U.S.C. 154(b) by 168 days.

(21) Appl. No.: 10/583,875

(22) PCT Filed: May 9, 2005

(86) PCT No.: PCT/GB2005/001743

§ 371 (c)(1),
(2), (4) Date: Jun. 21, 2006

(87) PCT Pub. No.: WO2005/108203

PCT Pub. Date: Nov. 17, 2005

(65) Prior Publication Data

US 2007/0139913 A1 Jun. 21, 2007

(30) Foreign Application Priority Data

May 7, 2004 (GB) ..... 0410216.6

(51) Int. Cl.
*F21V 33/00* (2006.01)

(52) U.S. Cl. ..... 362/101; 362/267; 362/373

(58) Field of Classification Search ..... 362/96, 362/101, 237, 240, 242, 243, 244, 245, 267, 362/294, 373, 477, 800
See application file for complete search history.

(56) References Cited

U.S. PATENT DOCUMENTS

| | | | | |
|---|---|---|---|---|
| 5,800,041 | A * | 9/1998 | Poggi | 362/267 |
| 6,561,690 | B2 * | 5/2003 | Balestriero et al. | 362/240 |
| 7,303,301 | B2 * | 12/2007 | Koren et al. | 362/101 |
| 2004/0057234 | A1 * | 3/2004 | Mohacsi | 362/373 |
| 2005/0152146 | A1 * | 7/2005 | Owen et al. | 362/294 |

* cited by examiner

*Primary Examiner*—Y M. Lee
(74) *Attorney, Agent, or Firm*—Reinhart Boerner Van Deuren P.C.

(57) ABSTRACT

An underwater lighting unit (1) for marine or other underwater use incorporates LEDs (13) as the light source and provides an array of LEDs (13) mounted against the back wall (11) of a metal or thermally conductive plastic housing (10) which utilizes the cooling effect of direct contact between the water and the housing to dissipate the heat generated by the LEDs (13) in use. The LEDs (13) each have an associated collimator (20) protected from contact with the water in which the unit (1) is to be immersed by a sealed glass screen (22), and each LED may be from one to three watts or more in power. There may be 30 or more LEDs (13) and associated collimators (20) in each lighting unit (1). The lighting unit (1) may be mounted in a cofferdam (2) of a marine vessel, directly against or slightly forwardly of the back wall of the cofferdam, or may be surface-mounted on the hull (3) of the vessel directly against or slightly spaced from the hull (3) and below the waterline.

20 Claims, 8 Drawing Sheets

UNDERWATER LIGHTING APPARATUS

FIELD OF INVENTION

The invention relates to underwater lighting units for marine use, for swimming pools, and for other applications where high intensity illumination is required from a location that is permanently under water. The invention is particularly but not exclusively suited to underwater hull lighting units to be installed in cofferdams recessed into the hulls of yachts, boats and other marine craft or for surface-mounting on those hulls, for illuminating the water in the immediate vicinity of the craft.

BACKGROUND ART

Submersible lights for swimming pools are known, and generally comprise a sealed light unit behind a removable glass window and recessed into the wall of the pool. For maintenance, the water level is lowered, the glass window unbolted or unscrewed, and the lamp replaced. The lamp itself is conventionally a tungsten filament lamp, a fluorescent discharge tube or even a quartz halogen lamp. The technology is very basic and unsophisticated. US-A-2003/0048632 discloses a swimming pool light that uses diodes as the source of illumination.

Underwater hull light units for marine use are much more demanding. Generally, the illumination required is far brighter than a tungsten filament lamp bulb or fluorescent discharge tube could generate. Quartz halogen or metal halide HQI lamps are therefore used. The lamp is mounted internally of the marine vessel, and the light is directed outwardly through a window in the back of a cofferdam in the hull. A cofferdam is a recessed portion of the hull. In the case of a metal-hulled vessel the cofferdam is typically created by cutting a hole in the hull and welding in place a truncated metal cylinder. The line of truncation is flush with the outer surface of the hull. The back of the recess so created is typically vertical and includes the window through which the light shines. In the case of a fibre-reinforced hull the cofferdam is normally moulded integrally with the hull.

For marine insurance purposes the cofferdam installation for an underwater hull lighting unit must be as reliable as the remainder of the hull. It is in fact tested as if it were an integral part of the hull. For that reason it has never before been thought feasible to wire the submersible lights through the wall of the cofferdam to the interior of the cofferdam. Almost always the wiring and the light source has been internally of the hull, and the light generated has been passed through the window in the cofferdam back wall. The only alternative method of mounting that has been used is to provide a sealed window across the front of the cofferdam, with the lighting unit housed inside a dry interior of the cofferdam and wired through the cofferdam wall to the hull interior. That has been feasible only because the cofferdam wall has been isolated from the surrounding water by the sealed front window.

The development of high output light emitting diodes (LEDs) of at least one watt per LED, more recently at least three watts per LED, has created a new and exciting opportunity for developing even brighter underwater lighting units. Modern high output LEDs have a very long mean lamp lifetime and can therefore be regarded as being substantially maintenance-free. They do, however, have a relatively high heat output from the rear of the LED and are therefore generally incorporated into relatively expensive cooling enclosures which obtain their cooling by complex heat sinks or by oil cooling.

Moreover the intensity of the illumination can be vastly increased by the use of individual collimators, one associated with each LED, to direct or focus the light output of the LEDs. The use of an array of even 1 watt LEDs, the least powerful of this new range of LEDs, in conjunction with collimators for the individual LEDs will produce a light output so bright that one would not wish to look directly at the light source. US-A-2003/0048632 does not contemplate the use of collimators, which in any case would be directly opposed to the general teaching of that Patent specification which even contemplates forming the LED clusters in the shape of letters in order to 'personalize' an illuminated swimming pool.

What is needed is a robust and reliable underwater light unit utilising modern high power LEDs in a novel enclosure which, instead of isolating the light source from the surrounding water, takes maximum benefit from the cooling potential of the surrounding water and brings the LEDs and the surrounding water into close heat-exchange relationship.

THE INVENTION

One embodiment provides an underwater lighting unit. The housing may be cast, formed or machined from a single piece of high thermal conductivity material such as metal, preferably stainless steel, aluminium or an aluminium alloy, or from an injection-moulded thermally conductive plastic material, so that the back and side walls are contiguous and joint-free. The plastic material may be an ABS based resin, optionally one that is glass fibre- or metal-filled; or a glass fibre-filled nylon which optionally has other thermally conductive filler present; or a polyphthalamide (PPA) resin such as that sold under the Trade Mark AMODEL. If fillers are present, then the thermal conductivity of the resin can be considerably enhanced, but preferably the fillers should be such that they do not degrade when in contact with water, especially sea-water. The thermal conductivity of an injection-moulded housing can be enhanced by incorporating into the mould a plate of thermally conductive metal such as an aluminium or aluminium-bronze which helps to conduct the heat from the LEDs to the outside edge of the housing for heat exchange with the water in which the lighting unit is immersed. If desired the outside edge of such a metal plate can be exposed to the outside of the housing. Alternatively it may be completely encapsulated in the plastic of the housing, in which case the heat transfer to the outside surface of the housing can be enhanced by creating the encapsulating layer of the plastic housing material thin in the areas where the maximum heat transfer is to take place, for example where the encapsulated metal plate approaches the edge of the housing.

The screen, which is preferably of toughened glass, for example 6 or 8 mm thick heat-toughened borosilicate glass, is recessed into the housing by being received in the peripheral recess of the side wall or walls of the housing preferably so as to lie flush with the front edge of that side wall or of those side walls, and is preferably sealed and secured in place by a continuous bead of silicone resin that is placed around the recess before installation of the glass screen.

The collimators, which act as reflectors or lenses, are incorporated into the assembly before the glass screen is fitted. Preferably one collimator is placed in front of each LED lens before fitting the glass screen. Each collimator may be a solid conical or pyramidal moulding of clear acrylic resin, with a small recess formed at the apex of each cone or pyramid for fitting closely around and receiving the lens portion of the associated LED. The transmission face of each cone or pyramid may be round or angular, such as hexagonal. Hexagonal pyramids are preferred, because they can be stacked together without gaps between the outwardly facing transmission faces of a cluster of collimators. The collimators may be moulded individually and assembled into a final array over the array of associated LEDs on assembly of the lighting unit, or they may be moulded as a conjoined group or cluster. Light generated by the LEDs is reflected by total internal reflection from the conical surfaces of the collimators, and the cone angle dictates whether the collimated beam produced by the array of LEDs is convergent, divergent or parallel. Preferably the axial length of each conical collimator is substantially equal to the distance between the potting compound holding the LEDs in place and the inside wall of the glass screen, so that the collimators provide support for the glass screen across the entire face of the screen, to reinforce the support provided by its edge mounting in the peripheral recess of the housing.

Because the collimators rely on total internal reflection of the light, they will work only when surrounded by a gas such as air or a medium with a coefficient of refraction well below that of the clear material (e.g. acrylic resin) from which they are formed. The seal that is formed between the transparent screen and the housing is therefore of ultimate importance in establishing the performance of the lighting unit, as is the seal preventing the ingress of water to the backs of the LEDs.

The underwater lighting unit is preferably assembled by arranging the LEDs in the desired array on a printed circuit board or boards against the back wall of the housing and passing the electrical leads for supplying electrical power to those LEDs through at least one aperture in the back wall of the housing. If the LEDs are arranged in a generally circular cluster then the aperture is preferably generally centrally behind the cluster. If the LEDs are arranged in a generally linear array then the aperture may be at the centre of the array or near one end of the array, or the electrical leads may pass through a pair of apertures in the back wall of the housing, situated near opposite ends of the array. The LEDs are preferably cemented in place using a heat-conductive thermosetting resin and subsequently potted in a resin which covers the whole of the back wall of the housing and encapsulates all of the printed circuit boards and soldered connections associated with the array of LEDs, leaving only the LED lenses exposed. The or each aperture in the back wall of the housing preferably leads to a hollow tubular externally screw threaded mounting stem through which the electrical leads pass, and preferably additional thermosetting resin compound is injected into that hollow tubular mounting stem so as to encapsulate the electrical leads as they pass therethrough. In that way three distinct water barriers are created between the front of the lighting unit and the rear of the mounting stem. A first water barrier is created around the edge of the glass screen which is bonded to the housing through the waterproof silicone seal. A second water barrier is created by the potting compound that encapsulates all but the lens portions of the array of LEDs. A third water barrier is created by the potting compound or by an injected silicone sealant which encapsulates the electrical connector wires as they pass through the mounting stem. An additional water barrier could, if desired, be created by incorporating a waterproof gland around the connecting wires and between the connecting wires and the mounting stem, as the wires pass from the rear of that mounting stem.

The lighting unit as so far described is complete in itself and can be used in any static underwater location such as a swimming pool or jetty, because the LEDs and the collimators are well protected from the ingress of the surrounding water. In use, the water contacts the housing directly. When the lighting unit is submerged in use, the front wall of the screen is in direct contact with the surrounding water, and the side wall or walls and preferably also the back wall of the housing, apart from the small mounting stem portion, are also in direct contact with the water. The water in which the lighting unit is used is an excellent cooling medium, and provides a proper degree of cooling for the LEDs.

One very important application for an underwater lighting unit is in underwater hull lighting systems for the hulls of yachts, boats and other marine craft. The lighting unit may be recessed into the hull of the marine craft or surface-mounted. For a recessed mounting, a lighting unit exactly as described above may be mounted across the back of a cofferdam that is recessed into the hull of the craft. No glass window is provided across the cofferdam in front of the lighting unit, so that the water in which the craft is afloat enters the cofferdam and surrounds the side wall or walls and optionally part of the back wall of the housing to achieve the LED cooling described above. The screw threaded mounting stem and associated electrical wiring pass through an optionally screw-threaded aperture in the back of the cofferdam and into the inside of the hull where it is captured by a nut together with an optional lock-nut. There is no danger at all of water passing through the lighting unit to the hull interior through the hollow mounting stem, and the only seal that is needed between the lighting unit and the rear wall of the cofferdam is a seal around the base of the mounting stem. Preferably that seal is as described and claimed in British Patent Specification No. 2258035. An annular sealing gland such as a silicone rubber seal or a polyurethane rubber seal concentric with the mounting stem is compressed between the rear wall of the housing and the back wall of the cofferdam. An outstanding annular rib is formed on the rear face of the back wall of the housing; and a cooperating annular rib is formed on the inside of the back of the cofferdam, concentrically around the mounting hole. The ribs are of different radii, so that the sealing gland is deformed as it passes around first of all the rib on the back of the lighting unit and then the rib on the back wall of the cofferdam. Such a seal is more or less as disclosed in British Patent Specification No. 2258035 but a considerable improvement in the sealing function can be obtained by having two or more annular ribs on the back of the cofferdam and two or more annular ribs on the back of the lighting unit, of progressively increasing diameters so that on tightening the sealing gland is bent into a generally corrugated shape as it is bent over the successive ribs on the lighting unit and cofferdam. If desired further sealing flanges can be provided within the hole, where the screw threaded mounting stem is secured and locked in place by a nut.

As indicated above, the lighting unit may alternatively be surface-mounted below the waterline on the hull of a yacht, boat or other marine craft. Any surface-mounted unit is preferably streamlined in shape, to generate reduced water resistance and drag as the craft moves through the water. The housing and lens are preferably of a linear configuration, for example with a footprint (where the housing contacts the hull) of typically 100 to 200 mm in length and 15 mm to 25 mm in depth. The shape of the housing and lens preferably extends in a rounded outline from a generally flat back face which contacts the hull, and preferably has angled or rounded leading and trailing ends. Mounting bolts for connecting the lighting unit to the hull of the craft are preferably provided one near each end of the housing, and one or possibly both of the mounting bolts may be hollow to create the hollow tubular externally screw-threaded mounting stem through which the electrical leads for powering the LEDs pass. All of the water seal features discussed above are also relevant to this surface design of lighting unit.

DRAWINGS

Figure 1:
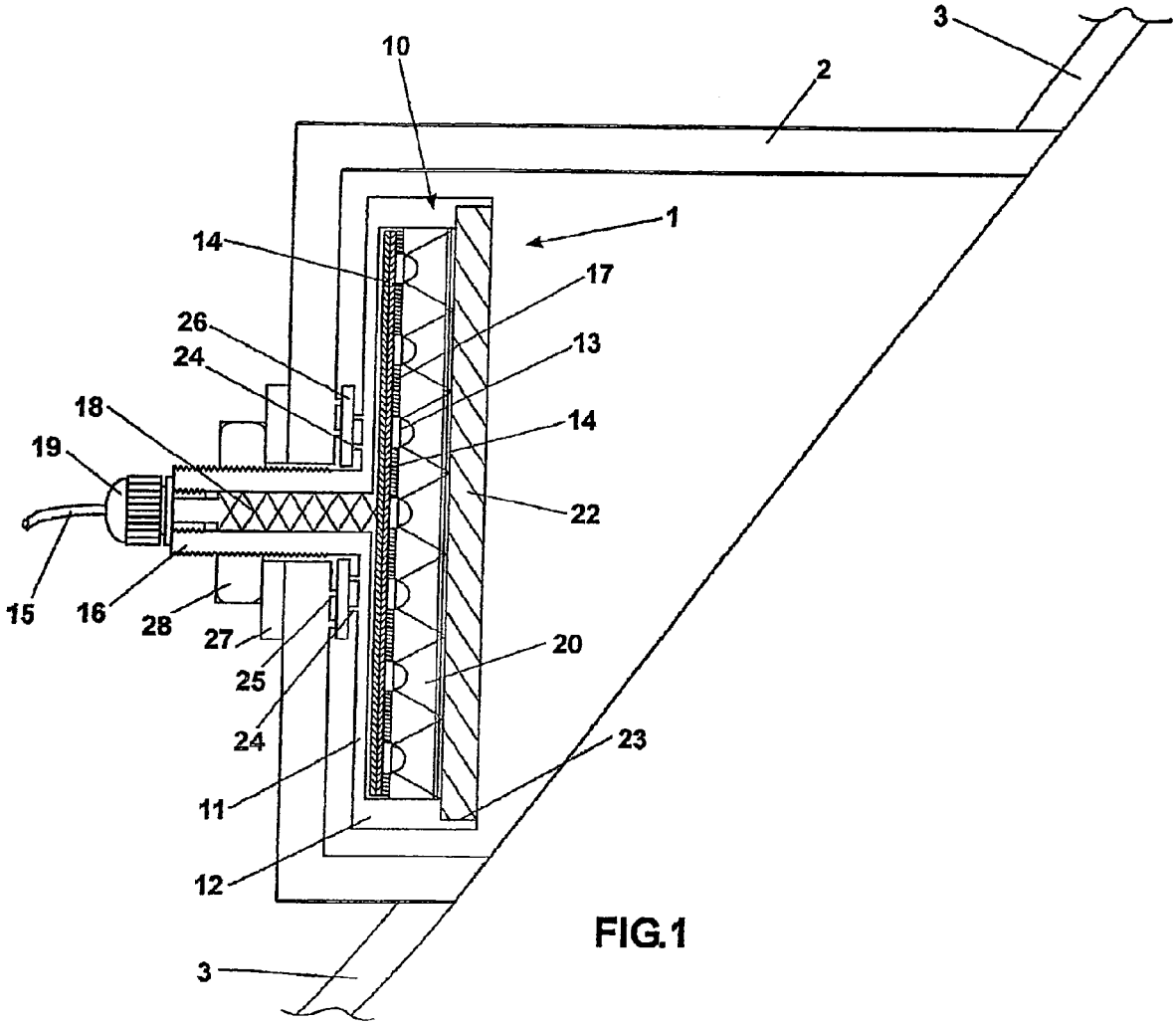
FIG. 1 is an axial section through a marine hull underwater lighting unit mounted in a cofferdam welded to the hull of a marine craft.
Figure 2:
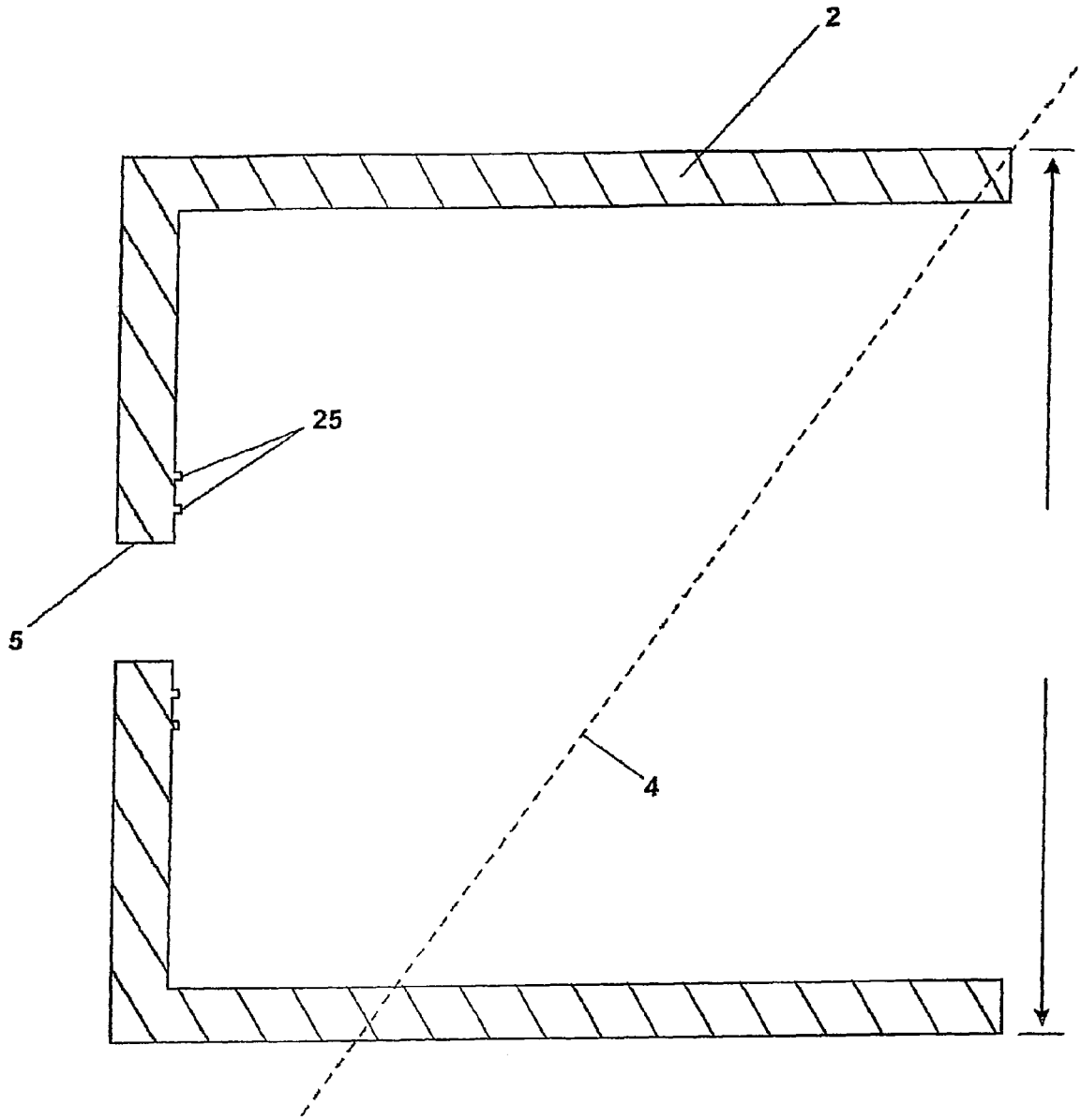
FIG. 2 is an axial section through the cofferdam itself, before it is cut to the angle of the hull.

Referring first to the embodiment of FIGS. 1 to 4, the marine hull underwater lighting assembly comprises a lighting unit 1 mounted at the back of a cofferdam 2 incorporated into the hull 3 of the craft. The cofferdam itself is illustrated in FIG. 2, and is a flat-ended cylindrical cup, which is formed from a single piece of metal, preferably stainless steel, aluminium or an aluminium alloy, so that it is joint-free. As initially formed, the cofferdam 2 has a constant axial length as shown in FIG. 2. It is then cut along the broken line 4 indicated in FIG. 2, which corresponds to the hull angle at the point of installation. The angle of the line of truncation 4 can be any angle consistent with the shape of the hull at the point of installation. Angles of 50° to the vertical are easily attainable, given a sufficient axial depth of the original cofferdam 2. The cofferdam 2 is welded to the boat hull 3, both externally and internally, so that structurally it becomes an integral part of the boat hull. The only point of potential ingress of water to the inside of the hull is a central mounting aperture 5 (FIG. 2) but this is reliably sealed as described below.

The rear wall of the cofferdam 2 is vertical, so that when a number of cofferdams are incorporated around the edge of the hull of the marine craft, all at the same level, the underwater lighting shining out from the lighting units 1 all shine horizontally and at the same depth, giving a uniform level of illumination when viewed from the deck of the craft.

Figure 7:
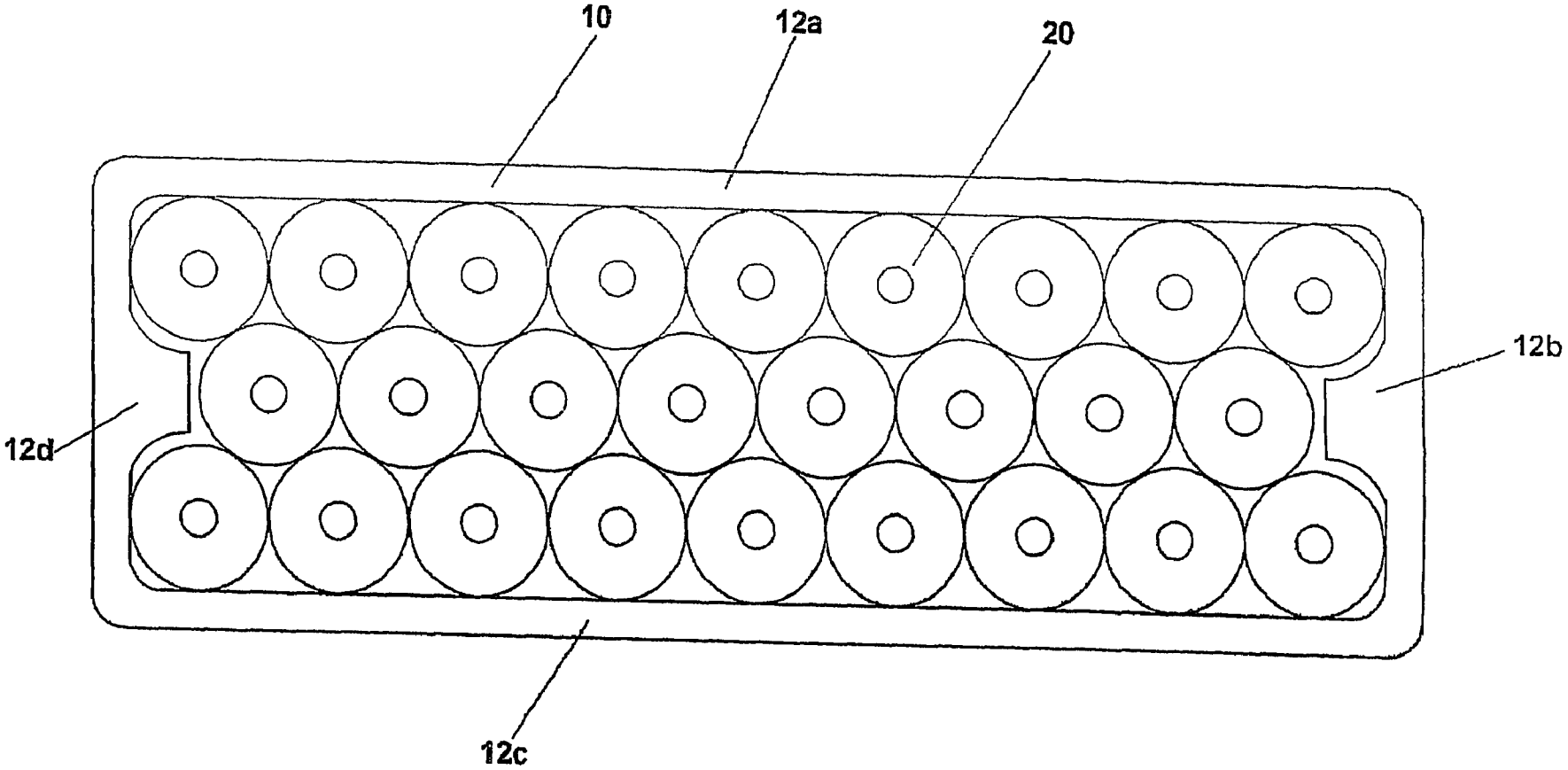
FIG. 7 is a front view of an alternative lighting unit in which the housing is generally rectangular in section rather than circular.

The lighting unit 1 embodiment comprises a housing 10 which is injection-moulded in a single piece from a highly thermally conductive plastic material or which is machined from a single piece of stainless steel, aluminium or aluminium alloy. There are therefore no joints in the housing to form potential water leakage points. The housing 10 is of dished shape, with a back wall 11 surrounded by a cylindrical side wall 12. The side wall 12 is described as a single side wall because it is circular, but a rectangular shape of lighting unit as shown in FIG. 7 could be considered as having four side walls 12*a*, 12*b*, 12*c* and 12*d*. The housing of the lighting unit of FIG. 7 would still, however, preferably be formed from a single injection-moulding of highly thermally conductive plastic material or from a single piece of metal, by milling.

Across the back wall 11 is arranged an array of LEDs 13 each mounted on its own printed circuit board 14. Preferably the printed circuit boards 14 are wired together in groups of LEDs 13 electrically connected in series or in parallel depending on which LEDs and which driver is used. The circuitry on the printed circuit boards 14 is preferably such that if any LED 13 in a series fails, then that failed LED is electrically by-passed so that the other LEDs in that same series still illuminate.

Electrical wiring 15 from the printed circuit boards 14 is gathered together and passes down the centre of an externally screw-threaded mounting stem 16 which is formed integrally with the remainder of the housing 10. A thermosetting resin compound 17 is spread across the back wall 11 of the housing, encapsulating the printed circuit boards 14 and securing them to the back wall 11, and leaving only the LEDs 13 exposed. The resin compound 17 'pots' the printed circuit boards and preferably has good thermal conductivity so that the printed circuit boards make good thermal contact with the back wall 11. A similar resin 18 is injected into the mounting stem 16, to encapsulate the electrical wiring 15. A screw cap 19 with a rubber sealing gland (not shown), that is tightened around the wiring 15 by screwing the cap 19 down hard is optionally applied as a further security precaution to prevent the ingress of water into the boat hull if all of the other seals were to break down or leak.

In front of the each LED 13 is placed an acrylic collimator 20. Each collimator 20 is a cone or pyramid of clear acrylic resin with a planar front face and a small indentation 21 at the apex of the cone, for receiving the associated LED 13. The collimators are sized so that they only just touch the inside surface of a glass screen 22. The screen 22, of at least 6 mm thick toughened glass, is located in a peripheral recess 23 around the inner front edge of the side wall 12 and is secured and sealed in place by a continuous bead of silicone resin (not shown).

Figure 13:
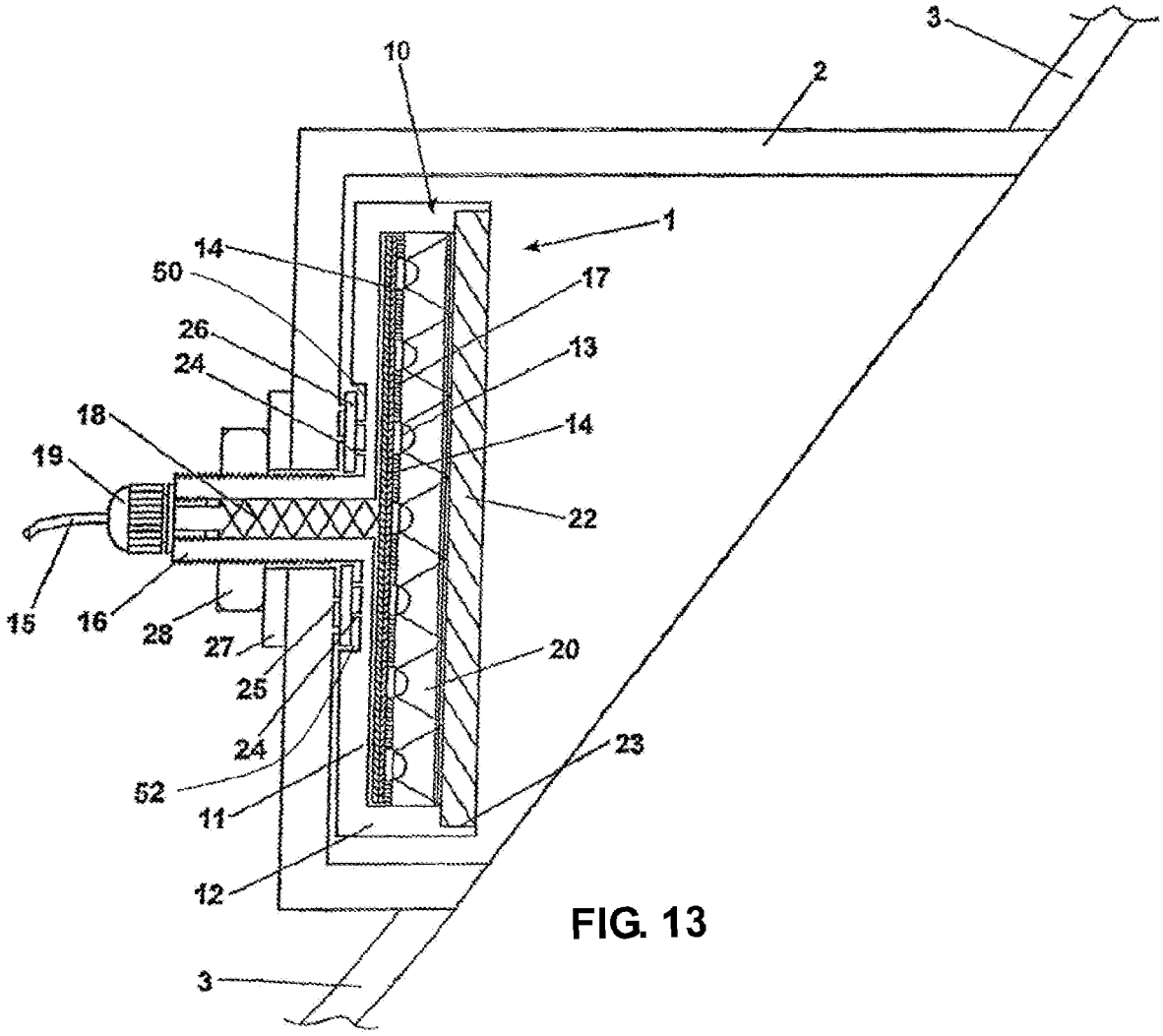
FIG. 13 is an axial section through a marine hull underwater lighting unit according to another embodiment of the invention mounted in a cofferdam welded to the hull of a marine craft.

Around the mounting stem 16 at the rear face of the lighting unit housing 11 are integrally formed a pair of rearwardly extending concentric annular ribs 24. The ribs 24 lie between a pair of oppositely facing outwardly extending concentric annular ribs 25 on the back wall of the cofferdam 2, and on assembly of the lighting unit 1 to the cofferdam 2 an initially flat sealing disc 26 of a silicone compound, or polyurethane rubber, or other elastomeric material, is trapped between the oppositely facing ribs 24 and 25. The mounting stem 16 is externally screw-threaded, and is pushed through the aperture 5 in the back wall of the cofferdam 2 where it is held in place by a washer 27 and nut 28. The nut 28 can therefore be screwed tight until the sealing disc 26 is distorted into a corrugated section by the opposed ribs 24 and 25. British Patent No 2258035 discloses the establishment of a very reliable seal by the use of an intermediate sealing gland and one such rib on each of two flat faces to be clamped together. The use of more than one concentric rib on each of the cofferdam back wall and the lighting unit back wall establishes a uniquely efficient seal. Even greater sealing security can be achieved by partially recessing the initially flat sealing disc 26 and the ribs 24 or 25 in a circular recess 52 in the rear wall of the housing 11 around the mounting stem 16 or in the back wall of the cofferdam 2 around the aperture 5 (as illustrated in FIG. 13). In this embodiment, the ribs 24 extend from a base 50 of the recess 52. Depending on the depth of the circular recess and the thickness of the sealing disc 26, accurate control can be achieved of the spacing between the rear wall of the housing 10 and the back wall of the cofferdam 2 when the unit is assembled and fully tightened. Preferably the spacing established between the two walls is from no space at all (surfaces touching) to a 2 mm spacing to allow for extra water cooling, which may be desirable depending on the power of the LEDs used.

The cofferdams 2 are generally submerged by no more than 1 or 2 meters, so the water pressure on the hull around the lighting units 1 is not excessive. However the security provided against leakage, and against water penetration to the interior of the hull, is massive. Water cannot pass to the hull interior through the lighting unit because the peripheral seal around the edge of the glass screen 22 provides a first seal. The glass is secure because it is a thick screen of toughened glass and because it receives support not only around its complete periphery but also across the whole of its face area from the collimators 20. A second water seal is provided by the resin 17 in which the printed circuit board or boards 14 of the LEDs 13 are set and encapsulated. A third water barrier and seal is provided by the resin or silicone sealant 18 that has been injected into the central bore of the mounting stem 16 around the wiring 15. A fourth water barrier (optional) is provided by the cap and gland 19.

Neither can water pass to the hull interior around the lighting unit 1 and between the mounting stem 16 and the cofferdam 2 because of the unique arrangement of the different diameter concentric ribs 24 and 25 and the way in which those ribs distort the initially flat sealing disc 26.

In use the cofferdam is below water level, and the water in which the craft is afloat fills the cofferdam 2 and contacts the glass screen 22, the side wall(s) 12 and optionally most of the rear wall 11 of the lighting unit 1. It has been found that a spacing of about 2 mm between the side walls of the lighting unit 1 and the cofferdam 2 is sufficient to achieve efficient cooling of the LEDs while being small enough to discourage unwanted marine growth such as barnacle growth. The LEDs are in good thermal contact with the back wall 11, and if the water surrounding the lighting unit includes 2 mm of water between the back wall 11 and the back wall of the cofferdam 2 then the heat dissipation properties of the water are sufficient to achieve excellent cooling of the LEDs. Alternatively if the cofferdam 2 itself is made of a thermally conductive material such as metal or a good thermally conductive plastic material, then the back wall 11 of the housing 10 can be held in close abutment with the back wall of the cofferdam 2 by the mounting stem 16 to achieve a good thermal heat dissipation in addition to that provided by the water surrounding the side walls of the lighting unit 1.

Figure 3:
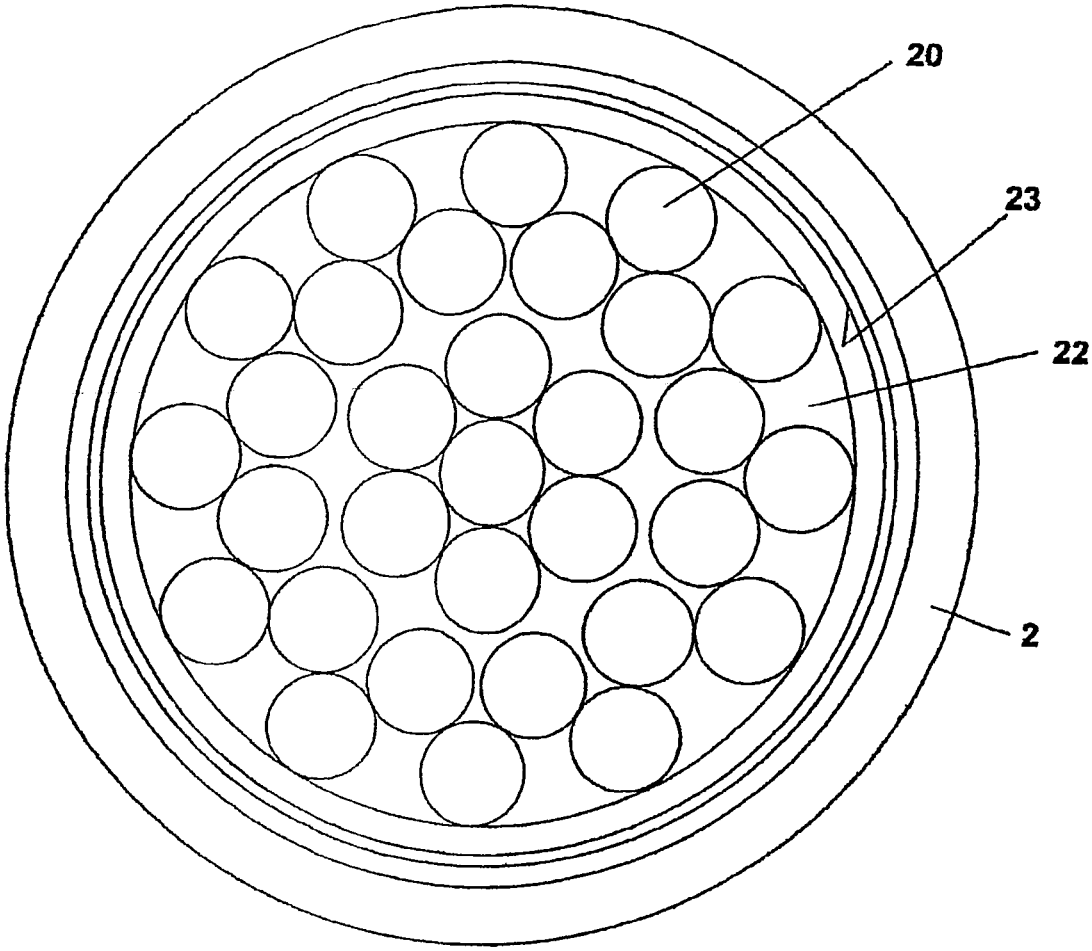
FIG. 3 is a front view of the lighting unit of FIG. 1.
Figure 4:
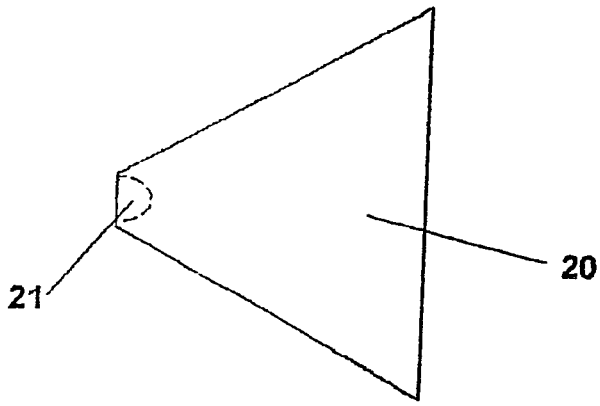
FIG. 4 is a side view of a collimator as used in FIG. 1.

It had been found that a lighting unit with 30 one-watt LEDs arranged as shown in FIG. 3 and an external diameter of no more than 150 mm has a light output in excess of any small sized submersible lighting unit currently on the market. However prototypes have also been constructed and tested with more than 30 three-watt LEDs in a similar configuration, and that vastly exceeds the light output of any currently available underwater lighting units of similar size and price.

The cooling water does not have to contact the back wall 11 of the lighting unit housing 10; it is sufficient that it is in good heat exchange contact with the side wall(s). The metal or highly thermally conductive plastic of the back wall 11 forms a good heat conduction path to transport the heat of the LEDs to the side walls for dissipation into the water. However, embodiments may provide an oil cooling structure within the lighting unit 1 so that heat generated by the LEDs is transported by the cooling oil to the side wall(s) 12 from where it is dissipated by heat exchange with the water.

Figure 5:
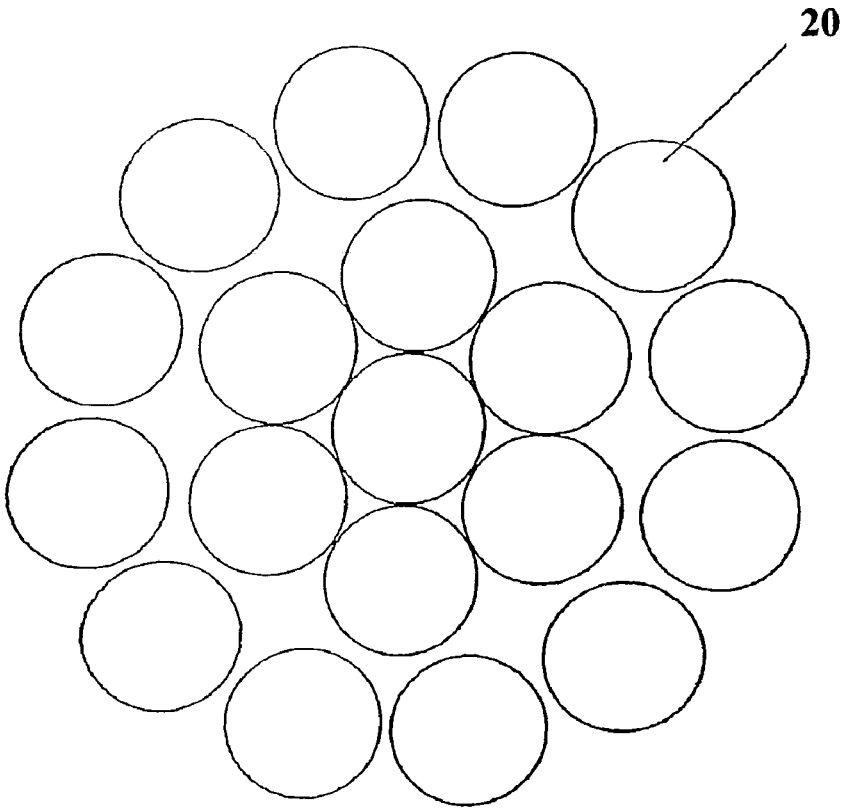
FIGS. 5 and 6 are schematic front views of similar lighting units, showing alternative numbers of LEDs in the array.
Figure 6:
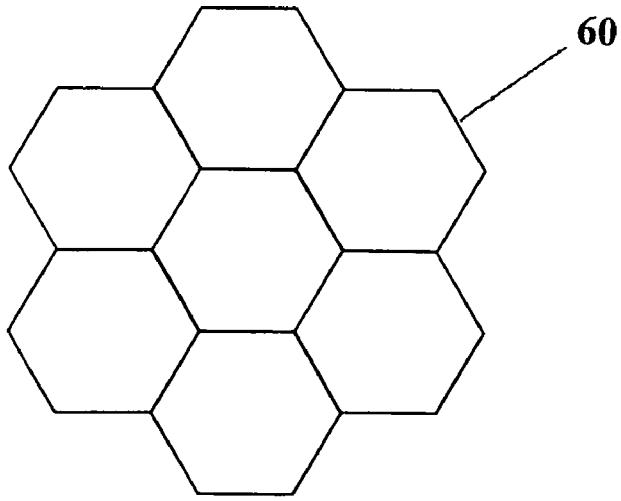

FIGS. 5, 6 and 7 show alternative arrays of LEDs that can be incorporated into lighting units. FIG. 5 depicts an array of 19 LEDs 20 with circular transmission faces, while FIG. 6 depicts an array of 7 LEDs 60 with hexagonal transmission faces.

Figure 8:
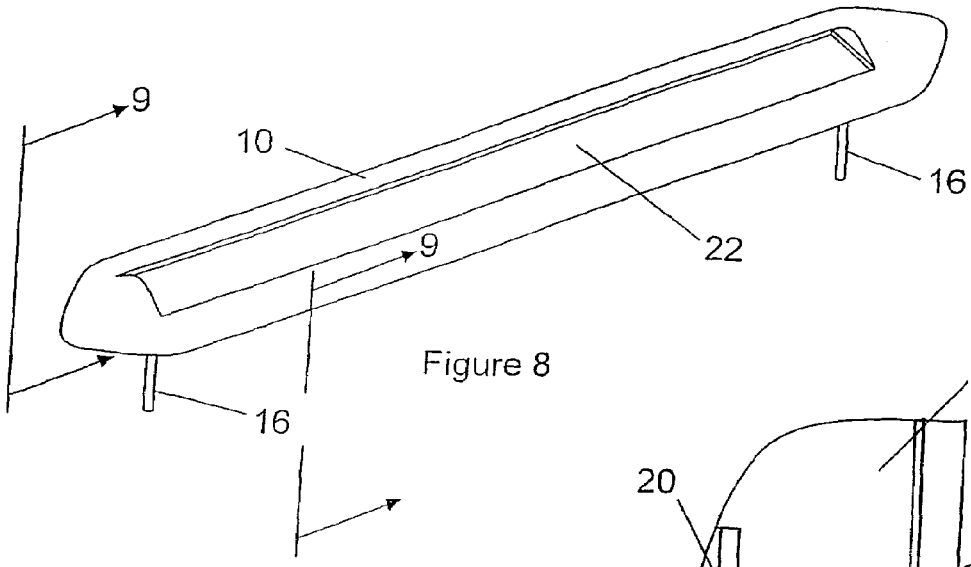
FIG. 8 is a perspective view of a surface-mounting lighting unit for mounting on a hull of a marine craft.
Figure 9:
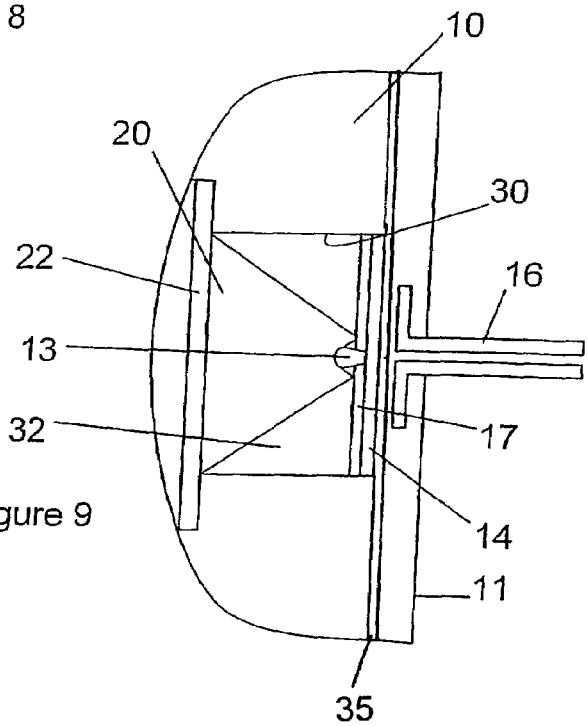
FIG. 9 is a cross-section through the lighting unit of FIG. 8, taken in the plane 9-9 shown in FIG. 8 but in the orientation it would assume when secured to the vertical portion of a boat hull.

FIGS. 8 and 9 illustrate a surface-mounting lighting unit embodiment for mounting on a hull of a yacht, boat or other marine craft below the waterline. Parts which are directly equivalent to the corresponding parts of the lighting units of FIGS. 1 to 7 have been given the same reference numerals as in those earlier Figures.

The housing 10 of FIGS. 8 and 9 is linear in shape with a generally flat rear face 11 which in use lies flat against or marginally spaced from the side of the hull beneath the waterline and is held in place by a pair of hollow-stemmed bolts 16 which are moulded into the housing 10 as shown in FIG. 9. The bolts 16 are located one near each end of the housing 10 as shown in FIG. 8. The bolts pass in use through a hole in the side wall of the boat hull below the waterline, with a sealing washer (not shown in FIGS. 8 and 9) creating a water seal just as the washer 26 did in FIG. 1. Some boat hulls are of double ply construction, in which case the bolts preferably pass through the central bore of a cylindrical mounting tube which passes through both plies of the hull with a good water seal established at the outer ply for example using a bead of silicone resin between an end flange of the mounting tube and the outer ply of the hull. Such a mounting tube is retained in position by a nut and optionally a locknut bearing against a washer held against the inner ply of the hull.

The housing 10 extends outwardly in a smooth curve from the rear face 11 as shown in FIG. 9, and at its leading and trailing ends tapers gently towards the flat rear face 11 presenting a streamlined profile with low water resistance as in use it projects from the underwater surface of the boat hull. Heat sink 35 extends from printed circuit board 14 to the outer edge of the housing to conduct heat away from the LEDs. The heat sink may be made from any thermally conductive metal.

The housing 10 is injection moulded from a highly thermally conductive thermoplastic material, and is formed with a central recess 30 which in use receives a linear array of LEDs 13. As in the embodiments of FIGS. 1 to 7, the LEDs 13 are mounted on one or more printed circuit boards 14 (FIG. 9) and are secured to the housing 10 in good thermal contact therewith using a thermally conductive thermosetting resin 17, and subsequently potted in a resin which covers the whole of the bottom of the recess 30 and encapsulates all of the printed circuit boards and soldered connections associated with the array of LEDs, leaving only the LED lenses exposed.

A toughened glass screen 22 extends across the front of the recess 30 and seats against a recessed shoulder of the housing 10 where it is sealed using a continuous bead of silicone resin (not shown) just as in the embodiments of FIGS. 1 to 7. A row of clear acrylic resin collimators 20 is located across the front of the LEDs 13, one collimator 20 per LED 13, with the planar front faces of the collimators 20 in contact with the toughened glass screen 22 as in the earlier embodiments. An air space 32 is formed between the collimators 13 and the moulded recess 30, which is important because the collimators 20 collimate by total internal reflection the light emitted from the LEDs 13.

Electrical wiring (not shown) is routed from the printed circuit board or boards 14, through the hollow stem of one or both mounting bolts 16 to LED driver circuitry internally of the boat hull. Just as in the previously described embodiments, that electrical wiring may if desired be sealed within a potting compound where it passes through the hollow stem of the bolt or bolts 16. Also a sealing gland or washer (not shown in FIG. 9) may be located between the boat hull and the generally flat rear face 11 of the housing 10, the flatness of that rear face 11 being interrupted by one or more annular ribs corresponding to the ribs 24 of the FIG. 1 embodiment. The corresponding ribs 25 are formed in the boat hull.

The collimators 20 may be moulded individually or may be conjoined in a single moulding, and function efficiently because they are reliably protected from water penetration by the silicone seal around the toughened glass screen 22 as in the FIG. 1 embodiment. The high heat output of the LEDs is efficiently conducted away and dissipated by the cooling effect of the water in which the craft floats. Heat flow from the LEDs to the surrounding water is efficiently conducted through the side walls of the housing 10 which is made of good thermally conducting material. If the housing 10 is mounted so as to be spaced slightly from the hull beneath the waterline, then the water passes also around the back of the housing 10 for increased heat dissipation. If the back of the housing 10 is mounted tightly against the hull then that contact provides a good degree of heat dissipation in addition to that provided by the cooling effect of the water in which the craft floats, which contacts the side walls of the housing. The heat dissipation through the back wall of the housing 10 may be augmented by forming the housing as an injection moulding around a metal plate which is exposed as the back face of the housing. Preferably the one or more printed circuit boards mounting the LEDs are in direct thermal contact with the said metal plate, to augment the heat dissipation directly to the hull of the boat.

Figure 10:
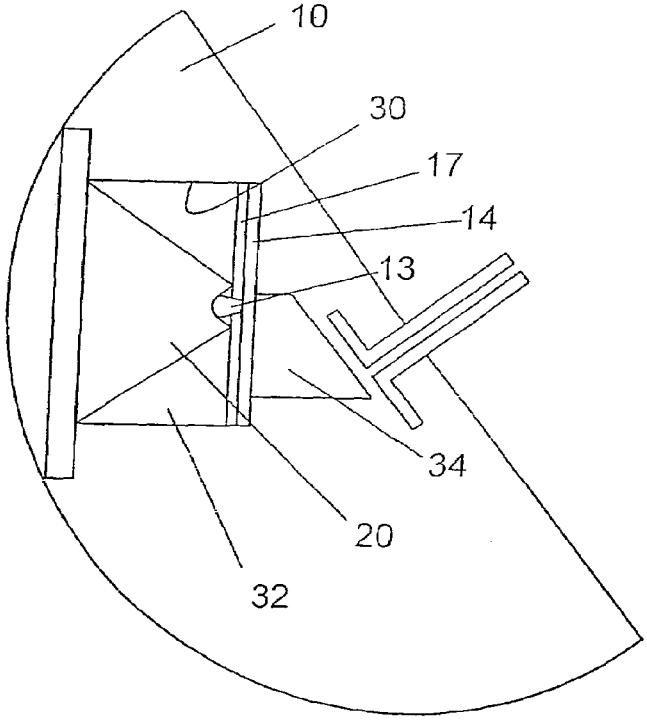
FIG. 10 is a cross-section similar to that of FIG. 9 but of a modification of the lighting unit of FIGS. 8 and 9 adapted to project a horizontally directed spread of light when mounted on a non-vertical portion of a boat hull.

FIG. 10 shows a variant of the embodiment of FIGS. 8 and 9 suitable for mounting against a sloping outer surface of the hull yet still transmitting a generally horizontal pattern of light. The moulded recess 30 of the FIG. 10 embodiment includes a deeper portion 34 for receiving the electrical wiring (not shown) which extends from the printed circuit board or boards 14 to the hollow stem or stems of the mounting bolts 16.

Figure 11:
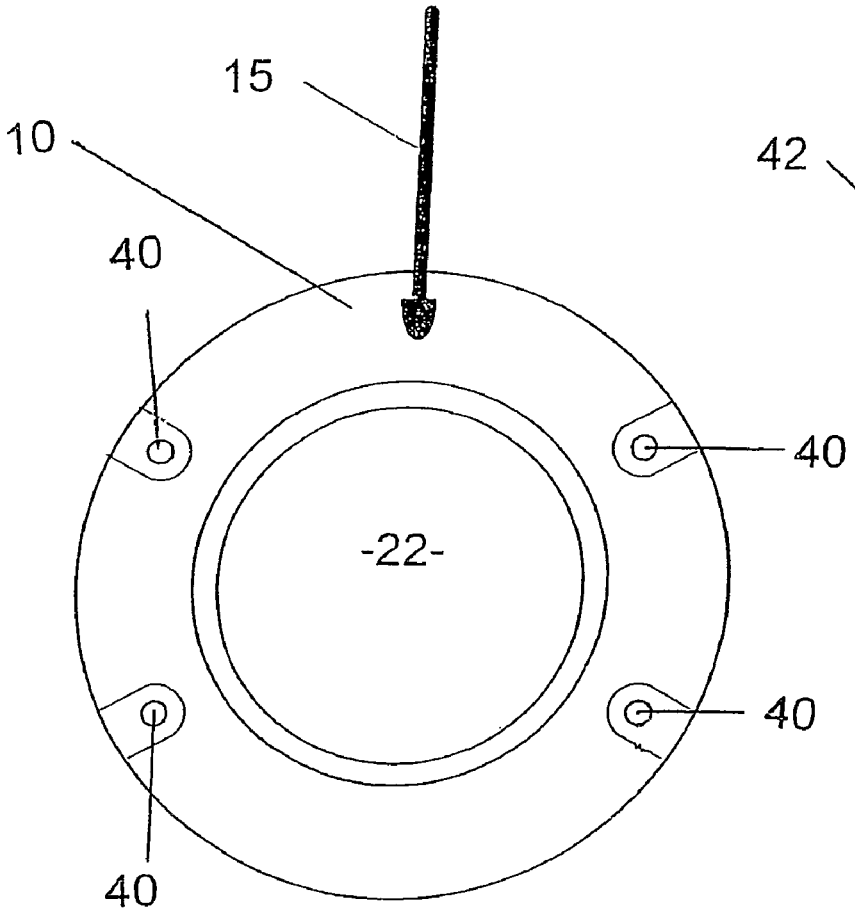
FIG. 11 is a front view of a surface-mounted lighting unit according to the invention with external wiring.
Figure 12:
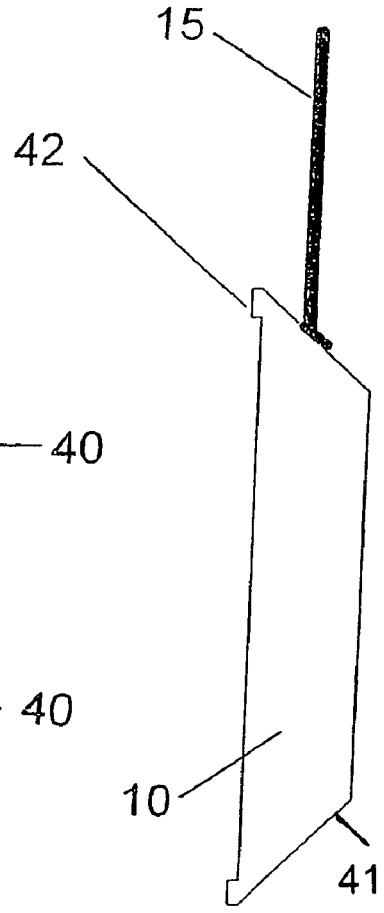
FIG. 12 is a side view of the lighting unit of FIG. 11.

FIGS. 11 and 12 show another embodiment, being a surface-mounted lighting unit for mounting on a transom of a boat. This embodiment differs from that of FIGS. 8 and 9 principally in the manner of fixing the lighting unit to the boat and in the manner of supplying electrical power to the LEDs, although in addition the LEDs of the lighting unit of FIGS. 11 and 12 are shown in a cluster in a round housing 10 rather than in a row in an elongate housing 10 as in FIG. 8.

The housing 10 of FIG. 11 is surface-mounted on the rear transom of a boat by four screws or bolts which in use pass through four countersunk holes 40 in the housing 10. The electrical wiring 15 from the printed circuit board mounting the LEDs (not shown) is brought out not from the back wall of the housing 10 but from an inclined side wall 41, and in use passes up the side of the boat transom and over the rear bulwark to an onboard power supply. Such a configuration is only really feasible for mounting at the stem of a boat because to pass the electrical wiring 15 up the outside of the boat hull along the sides would introduce considerable drag as the boat moves forwardly through the water.

FIG. 11 shows the glass screen 22 that is present in all other illustrated embodiments, but in the interest of simplicity the LEDs 13 and collimators 20, which are all exactly as described with reference to the earlier embodiments, are omitted from the illustration of the drawings.

FIG. 11 also shows integrally formed feet 42 which are moulded or cast or machined into the shape of the housing 10. Those feet 42 hold the back wall of the housing clear of the boat transom in use, so that the water in which the boat is floating passes around the back of the housing 10 to provide a proper degree of cooling of the LEDs within the housing 10. Typically the feet 42 hold the rear wall of the housing away from the boat transom by about 2 mm.

The invention claimed is:

1. An underwater lighting unit, comprising:

an array of light emitting diodes (LEDs) mounted against a wall of a thermally conductive housing;

a collimator comprising a clear transparent material in front of each LED in the array; and a transparent screen aligned across front faces of the collimators and in contact with said front faces, the transparent screen being sealingly edge-mounted in a peripheral recess around walls of the housing so as to create and maintain a sealed air space between an interior of the housing and walls of the collimators, at least a portion of the walls of the housing being in direct heat exchange contact with water in which the lighting unit is submerged to provide cooling for the array of LEDs.

2. An underwater lighting unit according to claim 1, wherein a back wall of the housing is in direct contact with a surface on which the array of light emitting diodes is mounted.

3. An underwater lighting unit according to claim 1, wherein the housing is cast, formed or machined from a single piece of metal so that back and side walls of the housing are contiguous and joint-free.

4. An underwater lighting unit according to claim 1, wherein the housing is formed from a plastic material and further comprising a plate of thermally conductive metal inside the housing and in thermal contact with the housing.

5. An underwater lighting unit according to claim 1, wherein the collimators have transmission faces in the general shape of a hexagon.

6. An underwater lighting unit according to claim 1, wherein the housing is injection-moulded from a thermally conductive plastic material with contiguous and joint-free back and side walls.

7. An underwater lighting unit according to claim 1, wherein the transparent screen is a toughened glass screen.

8. An underwater lighting unit according to claim 1, wherein the screen is received in the peripheral recess around at least one side wall of the housing so as to lie flush with a front edge of the at least one side wall, and the screen is sealed and secured in place by a continuous bead of silicone resin placed around the recess before installation of the screen.

9. An underwater lighting unit according to claim 1, wherein the LEDs are each at least 1 watt in power.

10. An underwater lighting unit according to claim 1, wherein the LEDs are mounted on at least one printed circuit board which is secured to a back wall of the housing by encapsulating the printed circuit board in a resin compound with only the LEDs exposed.

11. An underwater lighting unit comprising:

an array of light emitting diodes (LEDs) mounted against a wall of a thermally conductive housing;

a collimator comprising a conical or pyramidal moulding of a clear transparent material in front of each LED in the array; and a transparent screen aligned across front faces of the collimators and in contact with said front faces, the transparent screen being sealingly edge-mounted in a peripheral recess around side wall or walls of the housing so as to create and maintain a sealed air space between an interior of the housing and the conical or pyramidal walls of the collimators, at least a portion of walls of the housing being in direct heat exchange contact with water in which the lighting unit is submerged to provide cooling for the array of LEDs.

12. An underwater lighting unit according to claim 11, wherein electrical leads for supplying electrical power to the LEDs pass through at least one aperture in a back wall of the housing.

13. An underwater lighting unit according to claim 12, wherein the at least one aperture leads to an interior of a hollow tubular mounting stem extending from the back wall of the housing, the mounting stem being externally screw-threaded for mounting the underwater lighting unit through a back wall of a cofferdam of a marine vessel.

14. An underwater lighting unit according to claim 13, wherein the electrical leads pass through the mounting stem and are sealed therein by thermosetting resin injected into the hollow interior of the mounting stem around the electrical leads.

15. An underwater lighting unit according to claim 13 secured through the back wall of a cofferdam of a marine vessel, further comprising a seal between the housing of the lighting unit and the back wall of the cofferdam, the seal comprising an initially flat elastomeric sealing disc trapped between one or more rearwardly facing annular ribs on the back wall of the housing and one or more forwardly facing annular ribs on the back wall of the cofferdam, both ribs or sets of ribs being concentric with the mounting stem of the housing and being of increasing diameters so that the sealing disc is distorted into a corrugated shape as the housing and cofferdam are drawn tightly together.

16. An underwater lighting unit according to claim 15, wherein the back wall of the housing further comprising a circular recess and wherein the associated annular rib or ribs of the housing extend from a base of the circular recess.

17. An underwater lighting unit according to claim 11, wherein the LEDs are each at least one watt in power.

18. An underwater lighting unit, comprising an array of light emitting diodes (LEDs) mounted against a wall of a thermally conductive housing;

a collimator comprising a conical or pyramidal moulding of a clear transparent material in front of each LED in the array; and a transparent screen aligned across front faces of the collimators, the transparent screen being sealingly edge-mounted in a peripheral recess around side wall or walls of the housing so as to create and maintain a sealed air space between an interior of the housing and the conical or pyramidal walls of the collimators, at least a portion of walls of the housing being in direct heat exchange contact with water in which the lighting unit is submerged to provide cooling for the array of LEDs.

19. An underwater lighting unit according to claim 18, wherein there are 30 or more LEDs in the array.

20. An underwater lighting unit according to claim 18, wherein the collimators have hexagonal transmission faces.

* * * * *